US008894105B2

(12) United States Patent
Kutschat et al.

(10) Patent No.: US 8,894,105 B2
(45) Date of Patent: Nov. 25, 2014

(54) VEHICLE DOOR LOCK WITH INSIDE RELEASE LEVER

(75) Inventors: Horst Kutschat, Wuppertal (DE); Yvonne Haehnke, Wuppertal (DE)

(73) Assignee: D. La Porte Soehne GmbH, Wuppertal (DE)

( * ) Notice: Subject to any disclaimer, the term of this patent is extended or adjusted under 35 U.S.C. 154(b) by 298 days.

(21) Appl. No.: 12/736,494

(22) PCT Filed: Apr. 14, 2009

(86) PCT No.: PCT/EP2009/054407

§ 371 (c)(1), (2), (4) Date: Nov. 22, 2010

(87) PCT Pub. No.: WO2009/127625

PCT Pub. Date: Oct. 22, 2009

(65) Prior Publication Data

US 2011/0068586 A1 Mar. 24, 2011

(30) Foreign Application Priority Data

Apr. 14, 2008 (DE) ..... 20 2008 005 128 U

(51) Int. Cl.

| | |
|---|---|
| ***E05C 3/06*** | (2006.01) |
| ***E05B 85/26*** | (2014.01) |
| ***E05B 79/04*** | (2014.01) |
| ***E05B 85/24*** | (2014.01) |
| *E05B 85/10* | (2014.01) |
| *E05B 85/12* | (2014.01) |

(52) U.S. Cl.

CPC ..... *E05B 85/26* (2013.01); *E05B 79/04* (2013.01); *E05B 85/245* (2013.01); *E05B 85/247* (2013.01); *E05B 85/10* (2013.01); *E05B 85/12* (2013.01)

USPC ..... 292/214; 292/216; 292/56; 292/46; 292/173

(58) Field of Classification Search

USPC ..... 292/44–49, 52, 54

See application file for complete search history.

(56) References Cited

U.S. PATENT DOCUMENTS 2,028,954 A * 1/1936 Roedding ..... 292/126
2,888,288 A * 5/1959 Rigaud ..... 292/46

(Continued)

FOREIGN PATENT DOCUMENTS

DE 10 2006 012 956 3/2007
DE 102006012956 A1 * 3/2007 ..... E05B 65/32

(Continued)

OTHER PUBLICATIONS

International Search Report.

*Primary Examiner* — Kristina Fulton
*Assistant Examiner* — Thomas Neubauer
(74) *Attorney, Agent, or Firm* — Collard & Roe, P.C.

(57) ABSTRACT

The invention relates to a vehicle door lock having a rotary latch arrangement for locking doors of motor vehicles, in particular for tractors, having two rotatably mounted rotary latches, wherein for each rotary latch, provision is made of in each case one locking element which interacts therewith, which locking elements can interact with the rotary latches so as to lock the lock, and also having an actuating lever (35) by means of which the locking elements can be actuated so as to release the locking action, wherein the actuating lever (35) can be actuated from a first side of the lock (1) by being pressed, wherein the vehicle door lock (1) has an inside release lever (51) which can be actuated directly from an opposite side by being pressed, and wherein the actuating lever (35) can be driven by means of the inside release lever (51).

27 Claims, 9 Drawing Sheets

(56) References Cited

U.S. PATENT DOCUMENTS

| | | | | |
|---|---|---|---|---|
| 2,935,894 | A * | 5/1960 | Coronado-Arce | 74/503 |
| 3,014,417 | A * | 12/1961 | Maiershofer | 396/493 |
| 3,666,305 | A * | 5/1972 | Schlichter | 292/48 |
| 4,072,331 | A * | 2/1978 | Butterfield et al. | 292/173 |
| 5,437,173 | A * | 8/1995 | Spinar | 70/89 |
| 6,158,787 | A * | 12/2000 | Kutschat | 292/214 |
| 6,167,779 | B1 * | 1/2001 | Sano et al. | 74/543 |
| 6,419,284 | B1 * | 7/2002 | Kutschat | 292/56 |
| 6,857,922 | B2 * | 2/2005 | Fernandez | 440/101 |
| 7,309,087 | B2 * | 12/2007 | Lane et al. | 292/216 |
| 7,338,097 | B2 * | 3/2008 | Marzolf et al. | 292/216 |
| 2009/0134638 | A1 * | 5/2009 | Kutschat | 292/216 |
| 2010/0045052 | A1 | 2/2010 | Kutschat | |

FOREIGN PATENT DOCUMENTS

| | | |
|---|---|---|
| DE | 20 2007 005 292 | 6/2007 |
| DE | 20 2008 005 129 | 7/2008 |

* cited by examiner

VEHICLE DOOR LOCK WITH INSIDE RELEASE LEVER

CROSS REFERENCE TO RELATED APPLICATIONS

This application is the National Stage of PCT/EP2009/054407 filed on Apr. 14, 2009, which claims priority under 35 U.S.C. §119 of German Application No. 20 2008 005 128.2 filed on Apr. 14, 2008, the disclosure of which is incorporated by reference. The international application under PCT article 21(2) was not published in English.

The invention relates to a vehicle door lock having a rotary latch arrangement for closing and locking doors of motor vehicles, particularly doors of agricultural machinery, such as tractors, for example.

Figure 9:
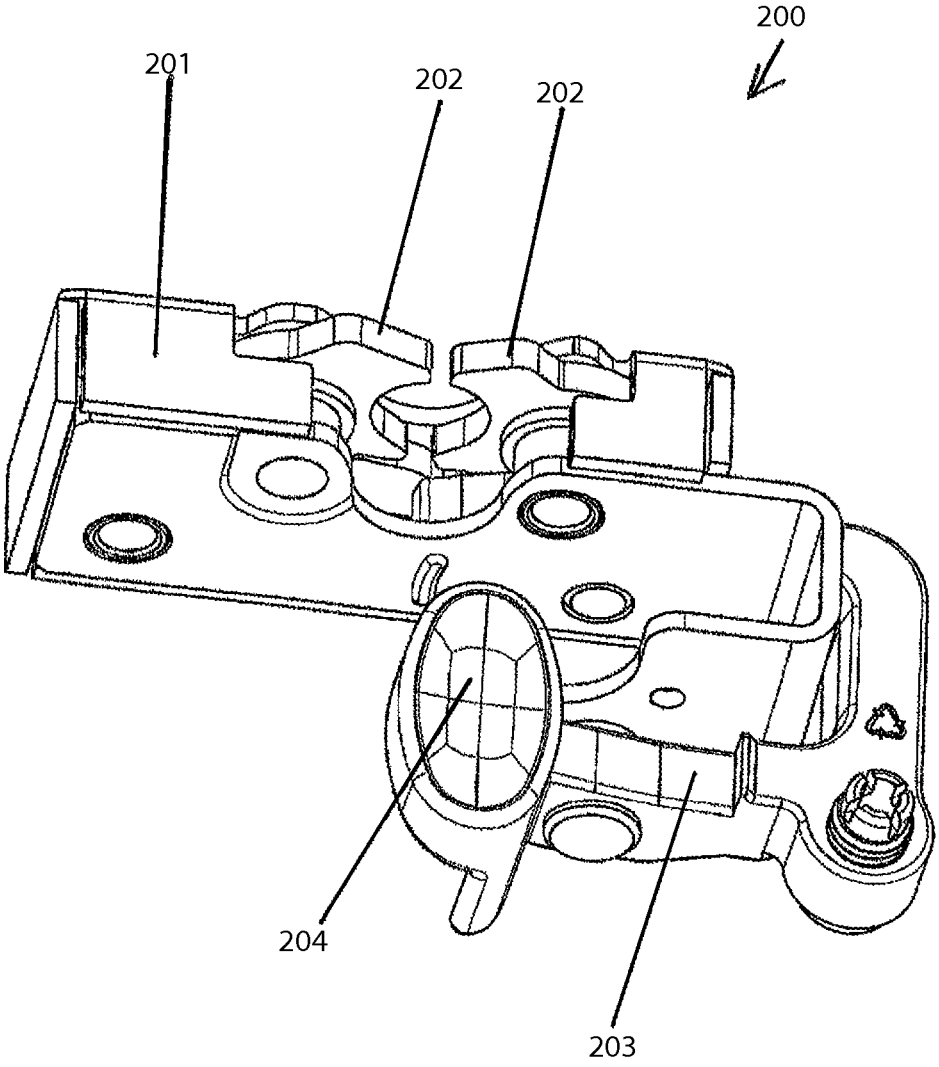

Such a door lock, which can be activated from close up both from the interior of the vehicle and from the exterior of the vehicle, is shown in FIG. 9. This lock 200 has a rotary latch mechanism disposed in a lock box 201, whereby a pawl is present to lock the two rotary latches 202. The pawl in turn can be activated by means of a U-shaped activation lever 203, in such a manner that the locking action can be released. For this purpose, the activation lever 203 engages into the lock box 201 and is configured in one piece and has a spatial shape that makes it possible for the activation lever 203, in the installed state of the lock 200, to be activated both from the exterior of the vehicle, for example by means of a pushbutton mechanism, and from the interior of the vehicle by means of pressing it. For this purpose, the activation lever has a handle 204 that can be grasped by hand from the vehicle interior. In this connection, mounting of the activation lever takes place directly on the lock box 201.

This lock has proven itself. However, the triggering forces to be applied for activation of the activation lever are relatively high, because of the relative massive construction of the activation lever.

It is the task of the invention to make available a vehicle lock that can be activated both from the interior of the vehicle and from the exterior of the vehicle, by means of pressing, that can be produced in cost-advantageous and simple manner, is easy to install, and in which the triggering forces to be applied for opening and closing are as low as possible.

These tasks are accomplished with the characteristics of claim 1. Advantageous further developments of the invention are characterized in the dependent claims.

Figure 1:
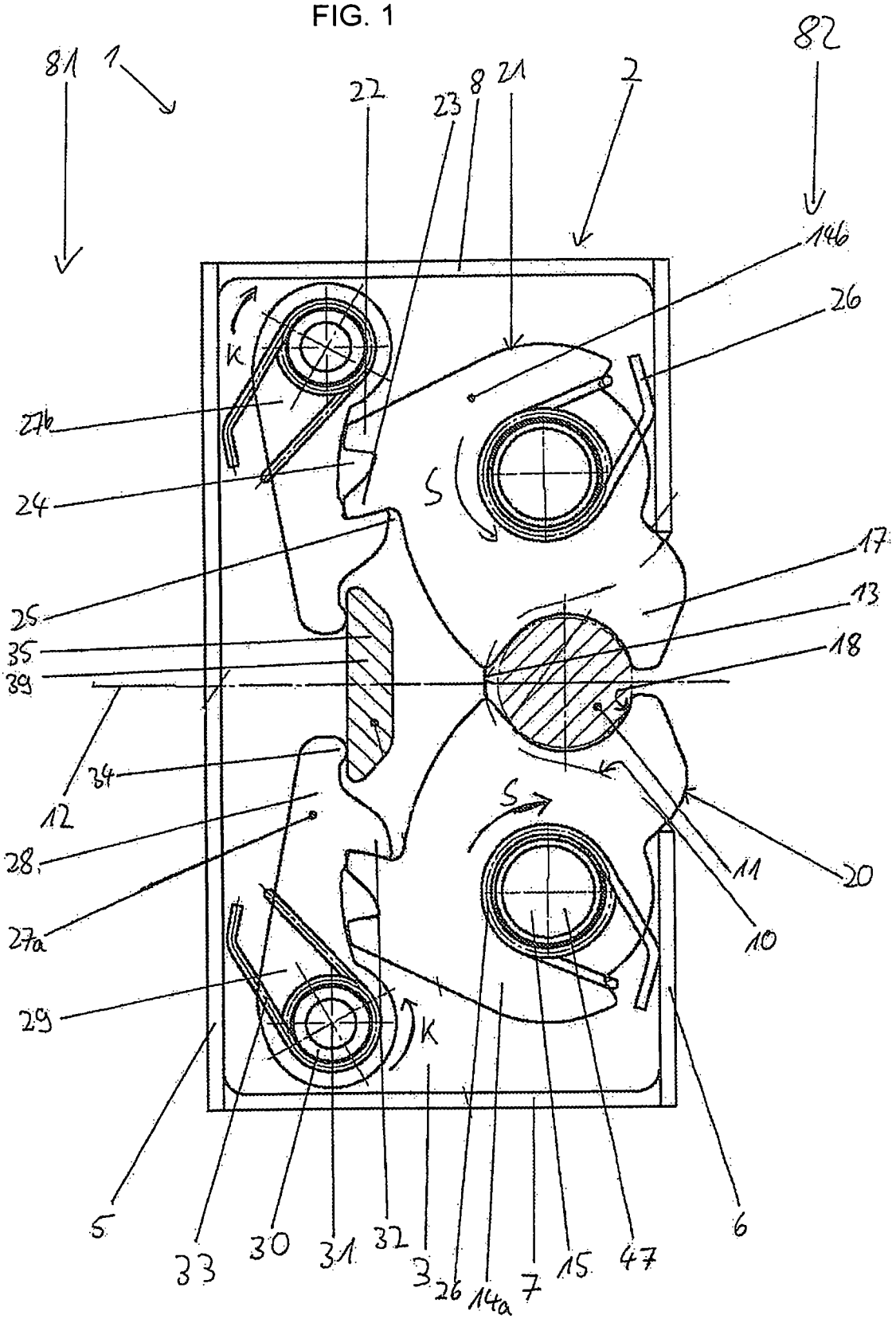
Figure 2:
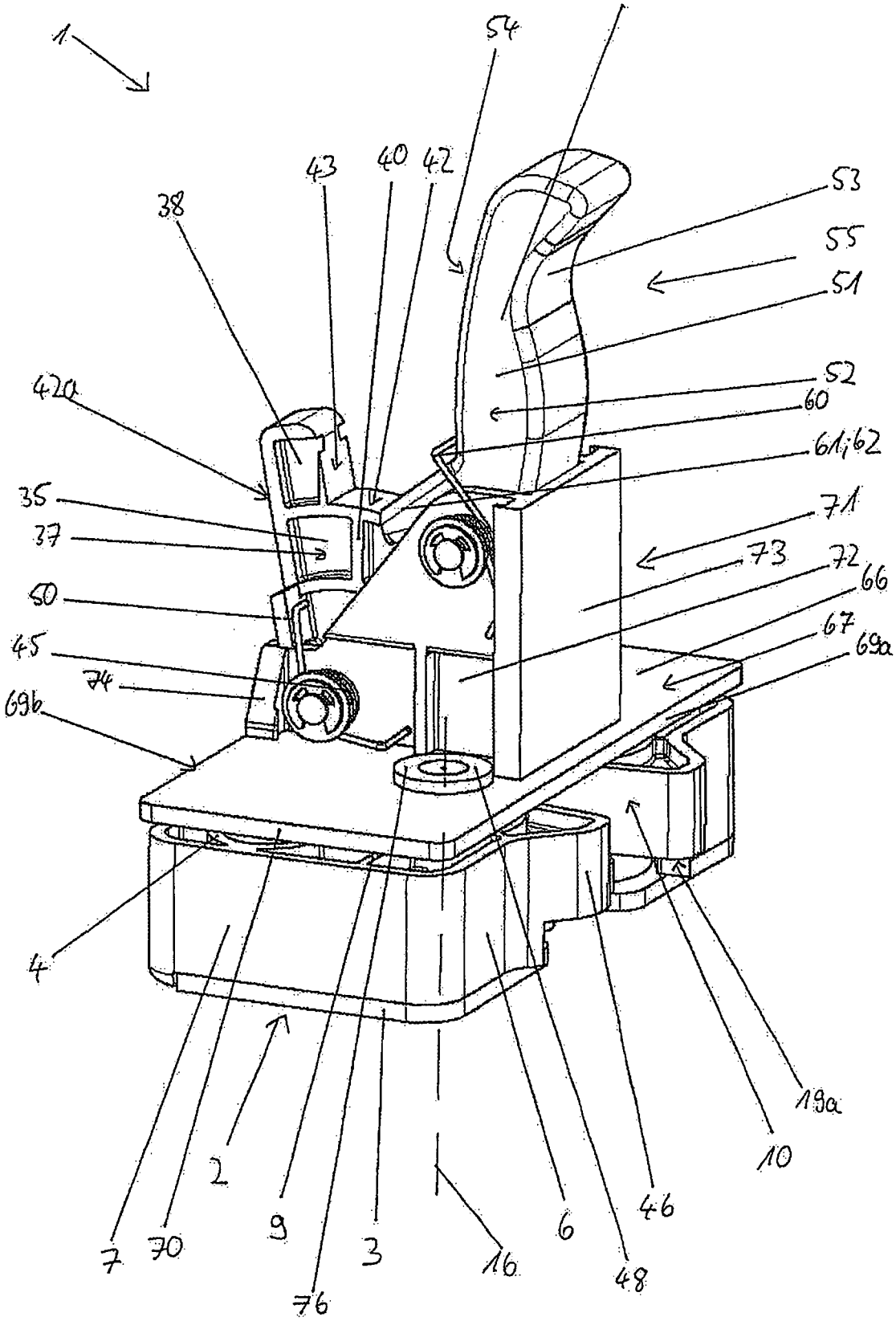
Figure 4:
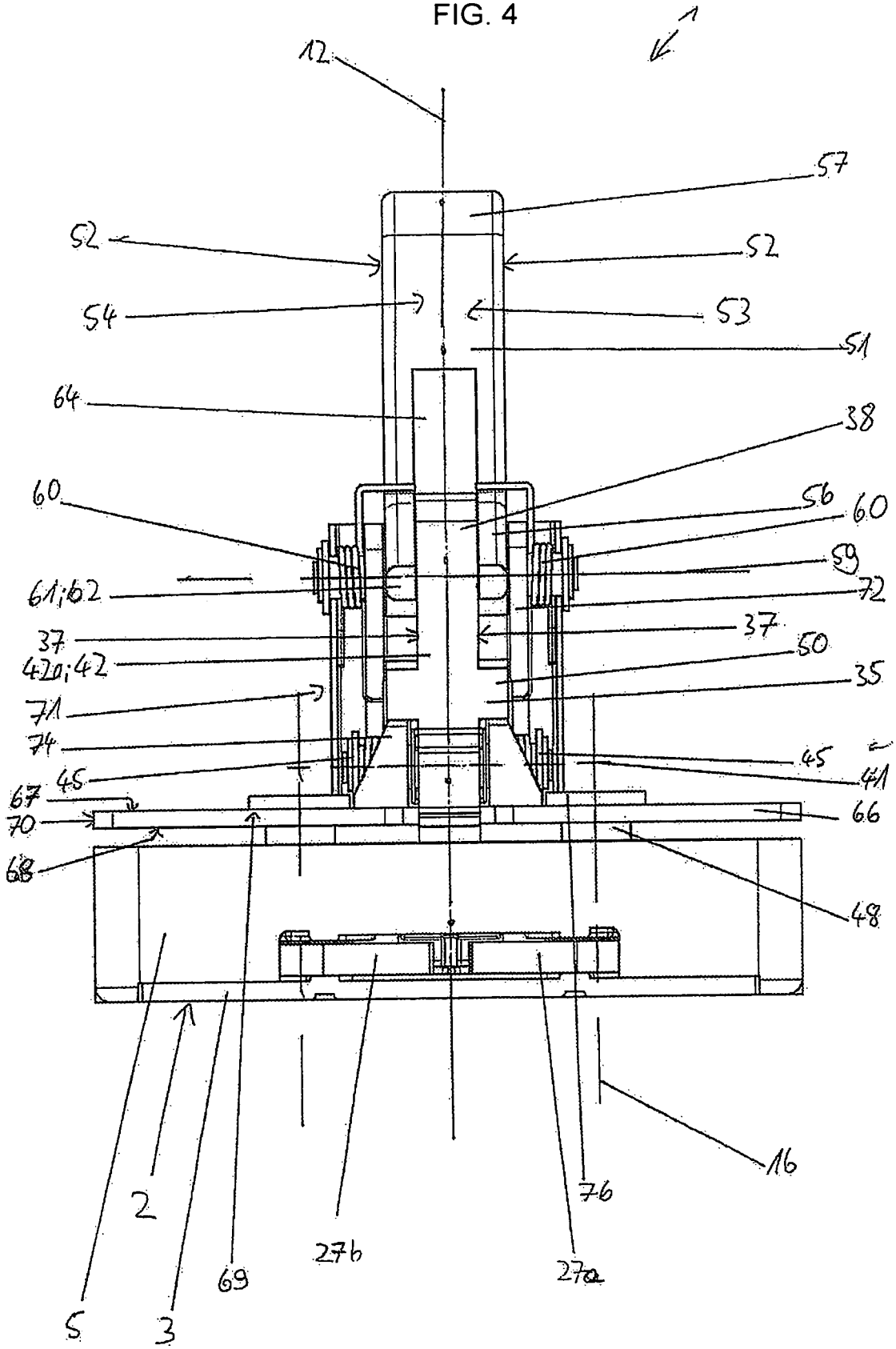
Figure 5:
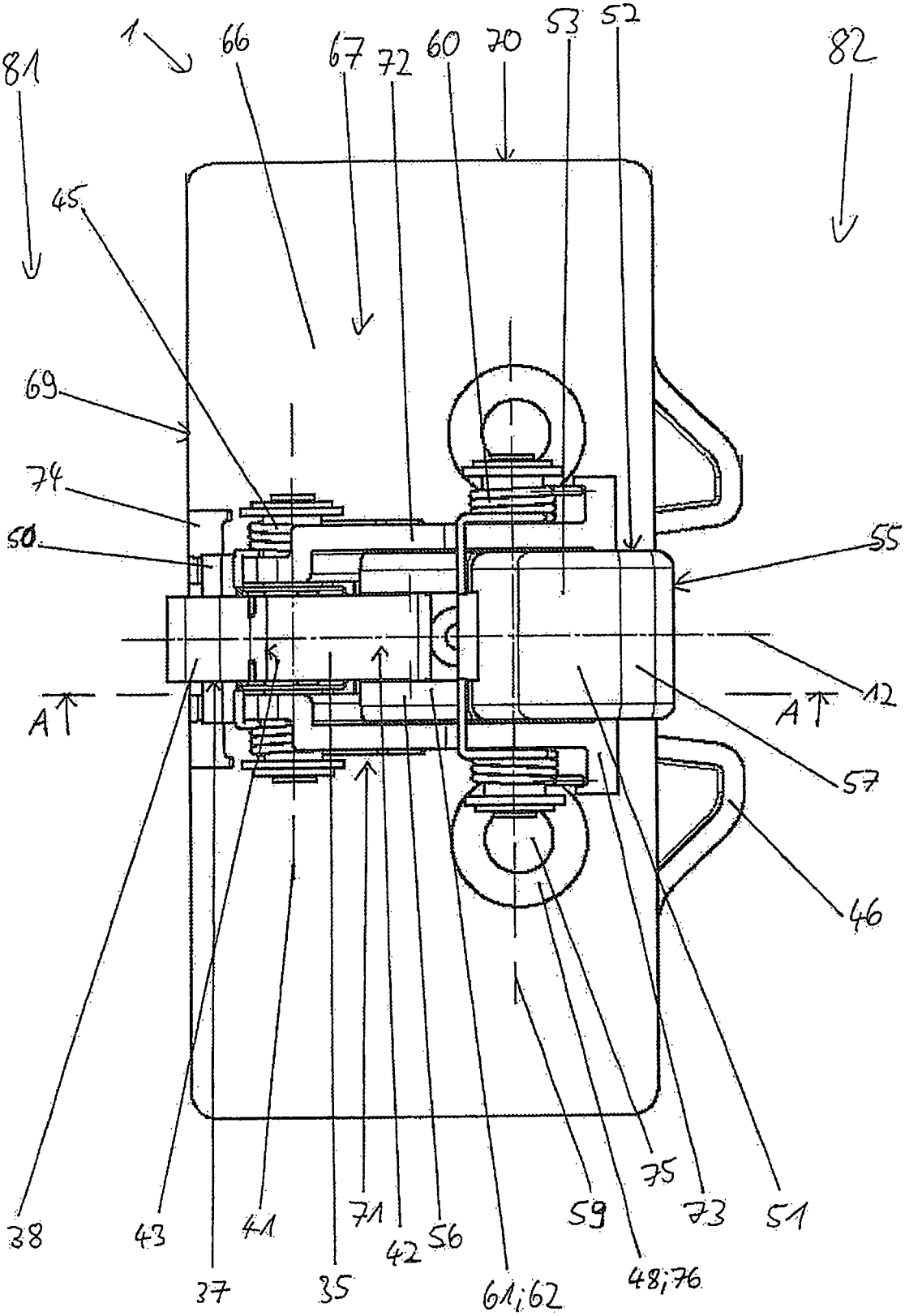
Figure 6:
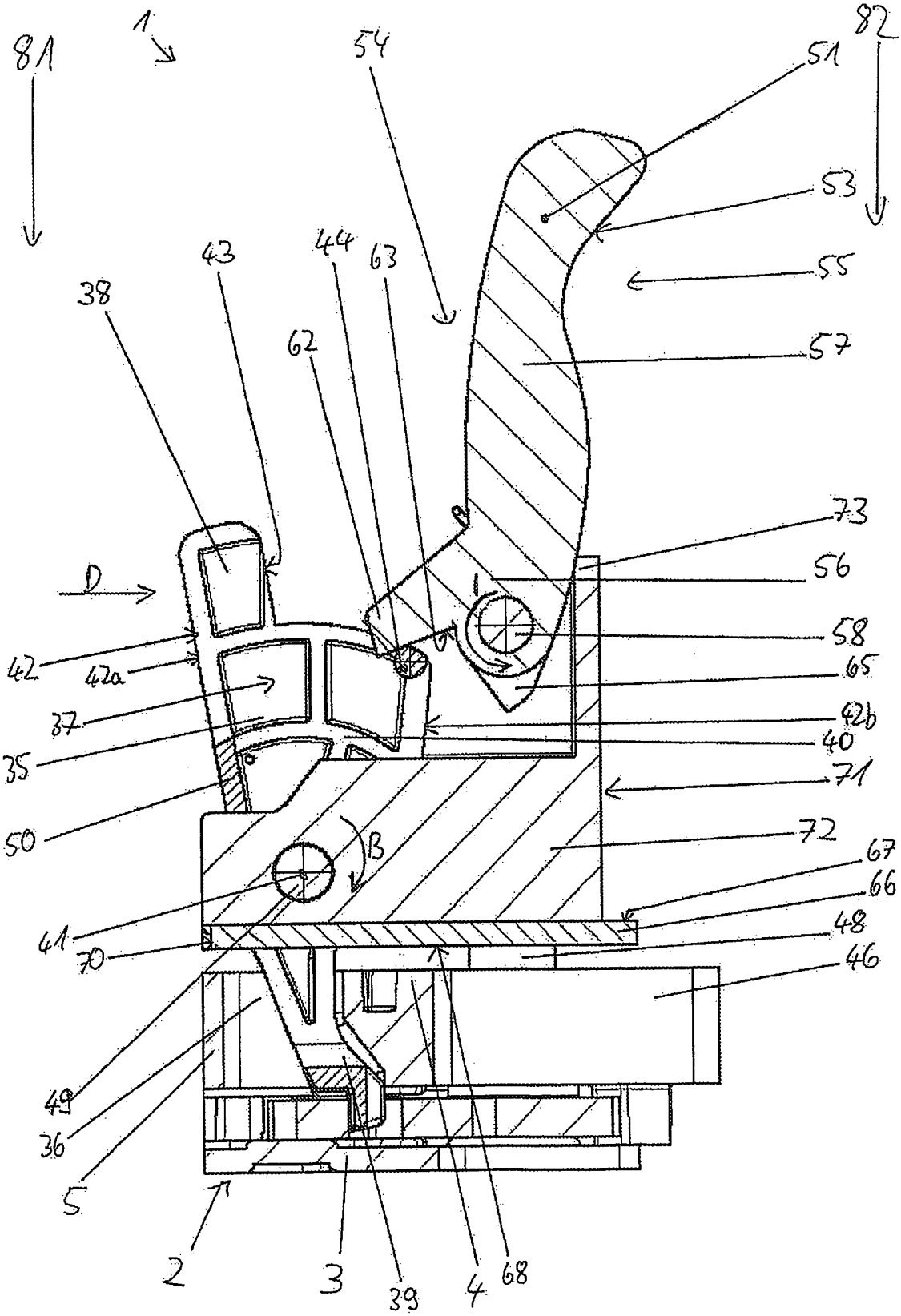
Figure 7:
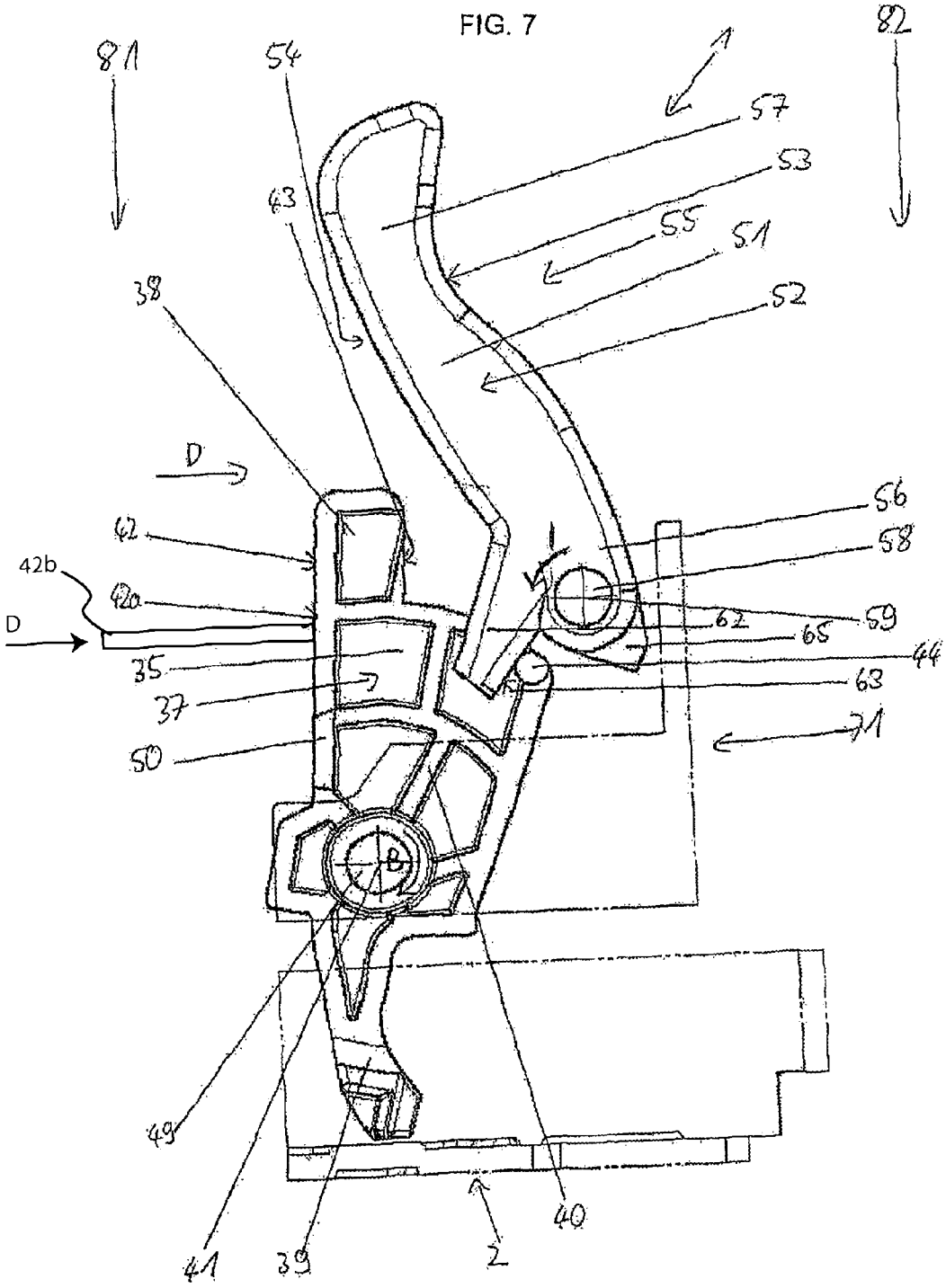
Figure 8:
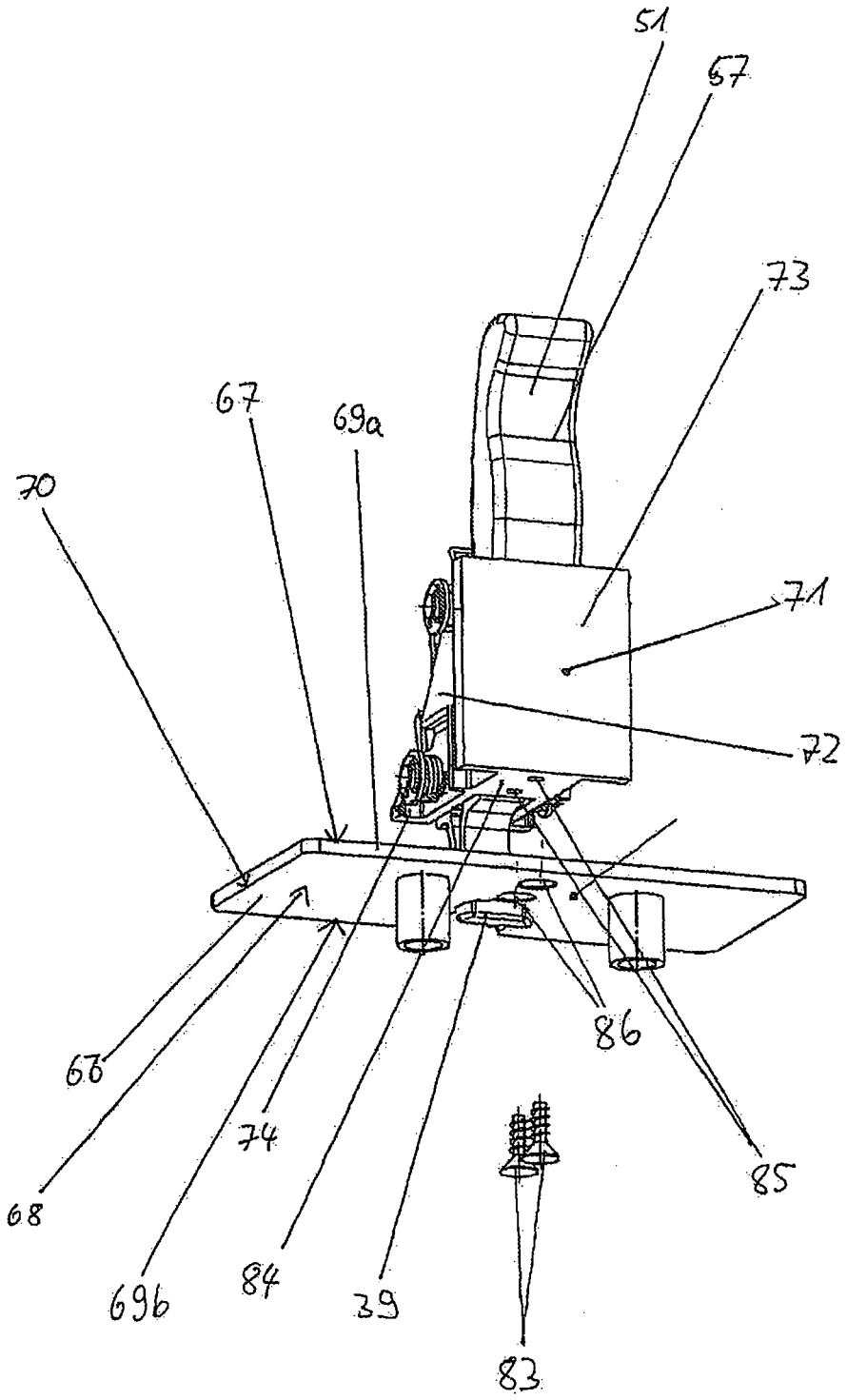

In the following, the invention will be explained in greater detail using a drawing as an example. This shows FIG. 1: A section of the vehicle door lock according to the invention, parallel to the lock cover, in a locked, closed position, FIG. 2: A side, isometric view of the vehicle door lock according to the invention, without a sheet metal holder, FIG. 3: An isometric, exploded view of the vehicle door lock according to the invention, FIG. 4: A view of the vehicle door lock according to the invention from the pressure lever side, in a longitudinal view or a view from the exterior of the vehicle, respectively, FIG. 5: A top view of the vehicle door lock according to the invention, FIG. 6: A cross-section of the vehicle door lock according to the invention, along the line A-A in FIG. 5, FIG. 7: A side view of an outside activation pushbutton lever and of an inside activation pushbutton lever in the activated position, FIG. 8: An isometric, bottom view of a metal attachment sheet with lever mechanism, FIG. 9: An isometric view of a lock according to the state of the art.

The door lock 1 according to the invention has a block-shaped lock box 2 having a preferably plate-shaped bottom wall 3, a lid 4 that lies opposite the bottom wall 3 and parallel to it, two preferably plate-shaped longitudinal walls 5, 6 that are parallel to one another and perpendicular to the bottom wall 3, as well as two preferably plate-shaped transverse walls 7, 8 that are parallel to one another and perpendicular to the longitudinal walls 5, 6 (FIG. 1-7). The lid 4 furthermore has reinforcement ribs 9 and is preferably configured in one piece with the longitudinal and transverse walls 5, 6, 7, 8.

In the lock box 2, a groove-shaped locking pin accommodation or recess 10 is provided, which extends continuously through the bottom wall 3, into the lid 4, and into the longitudinal wall 6, and creates space for accommodating a door locking pin 11 and guides the locking pin 11, as will be discussed in greater detail below. The locking pin accommodation 10 is configured symmetrical to a transverse center plane 12 of the door lock 1, and ends in a recess bottom 13, which is round, for practical purposes, preferably circular; in particular, the locking pin recess 10 has a V-shaped progression in a view perpendicular to the lid 4. It is practical if the lid 4 and the longitudinal wall 6 are configured to be curved slightly outward on both sides of the locking pin accommodation 10, so that additional guide and centering projections 46 are formed on both sides of the locking pin accommodation 10, which facilitate centering and introduction of the locking pin 11 into the locking pin accommodation 10.

Furthermore, the lock box 2 has two attachment recesses 47 that extend from the lid 4 to the bottom wall 3, continuously through the lock box 2, which serve, among other things, for attaching the lock 1 on a vehicle door. It is practical if the attachment recesses 47 are disposed on both sides adjacent to the locking pin recess 10 and preferably symmetrical to the transverse center plane 12.

Two rotary latches or rotary latch parts 14*a*; 14*b* are disposed within the lock box 2. The rotary latches 14*a*; 14*b* are plate-shaped elements, for example plates made of steel, which extend parallel to the bottom wall 3 and at a slight distance from it, and preferably have an identical spatial shape. Furthermore, the rotary latches 14*a*; 14*b* are disposed and configured symmetrical to the transverse center axis 12. A locking projection 17 having a channel 18 is configured on each rotary latch 14*a*; 14*b*, in each instance. The channels 18 of the two rotary latches 14*a*; 14*b* are disposed facing toward one another and serve to accommodate the locking pin 11, which extends perpendicular to the bottom wall 3 and is configured to be cylindrical, as will be discussed in greater detail below. In an open lock position, the locking projections 17 engage through a slit 19 provided in the longitudinal wall 6 that has the locking pin recess 10, which slit extends perpendicular to the transverse center plane 12 (FIG. 3, 4), and project laterally beyond the longitudinal wall 6. The slit 19 is also configured to be symmetrical to the transverse center plane 12 and extends parallel to the bottom wall 3 and, seen from the latter, approximately by slightly more than the amount of the thickness of the two rotary latches 14*a*; 14*b* into the longitudinal wall 6. Furthermore, the slit 19 has slit edges 19*a*, preferably oriented perpendicular to the bottom plate 3 (FIG. 1, 3, 4), which serve as contact edges for a projection back wall 20 of the locking projections 17, in each instance, that lie opposite the channel 18, in each instance, as will be discussed in greater detail below. Furthermore, a circumferential wall 21 of the rotary latches 14*a*; 14*b* has two adjacent first and second rotary latch projections 22, 23, in each instance, which are disposed essentially diametrically opposite the locking projections 17.

Furthermore, a first, for practical purposes a V-shaped engagement recess 24 is formed between the two rotary latch engagement projections 22, 23, which recess is preferably configured to be undercut. A second, for practical purposes also a V-shaped rotary latch engagement recess 25 is formed by the second rotary latch engagement projection 23 and the circumference wall 21 that follows the second rotary latch engagement projection 23.

The two rotary latches 14*a*; 14*b* are furthermore mounted in the lock box 2 so as to rotate about a rotary latch axis of rotation 16, in each instance, which axis is perpendicular to the bottom wall 3. For this purpose, the rotary latches 14*a*; 14*b* have a center mounting recess 15, with which the rotary latches 14*a*; 14*b* are mounted on an attachment bushing 48 that goes through the lock box 2, as will be discussed in greater detail below. It is practical if mounting of the rotary latches 14*a*; 14*b* takes place in the vicinity of the longitudinal wall 6 that has the locking pin recess 10, and symmetrically with reference to the transverse center plane 12 of the door lock 1. Furthermore, it is practical if a rotary latch spring or rotary latch helical spring 26 is present per rotary latch 14*a*; 14*b*, in each instance. The rotary latch springs 26 support themselves both on the rotary latches 14*a*; 14*b* and on the lock box 2, and have the aim of holding the rotary latches 14*a*; 14*b* in the open position, in other words of pressing the locking projections 17 that face one another apart, or they drive the rotary latches 14*a*; 14*b* about the rotary latch axes of rotation 16, counter to a closing direction S.

In order to lock the two rotary latches 14*a*; 14*b*, the door lock 1 according to the invention has two engagement blocking elements, particularly locking levers or pawls 27*a*; 27*b*, which hold the rotary latches 14*a*; 14*b* in a closed (FIG. 1) or pre-engaged position (not shown), or release the two rotary latches 14*a*; 14*b* (not shown). The two pawls 27*a*; 27*b* are also plate-shaped, for example made of steel, and configured to extend parallel to the bottom wall 3, and furthermore have an essentially elongated and preferably identical spatial shape, whereby a pawl activation section 28 is provided at one end, and a bearing section 29 is provided at the other end, in each instance. The bearing section 29 has a continuous recess, in each instance, with which the pawls 27*a*; 27*b* are mounted so as to rotate on pawl mounting pins 30, which are preferably hollow cylinders. In this connection, it is practical if the two pawl mounting pins 30 are firmly connected with the bottom wall 3. The pawls 27*a*; 27*b* are therefore mounted so as to rotate about a pawl axis of rotation 31 that is perpendicular to the bottom wall 3, particularly about the pawl axis of rotation 31. Furthermore, the two pawl bearing pins 30 are preferably disposed in corner regions that are formed by the transverse walls 7, 8 and the longitudinal wall 5, spaced apart from one another symmetrically with reference to the transverse center plane 12 of the door lock 1, so that the pawls 27*a*; 27*b* are also configured and disposed symmetrical to the transverse center plane 12.

The pawl activation section 28 of the two pawls 27*a*; 27*b* has a formed-on pawl engagement projection 32, in each instance, which is configured to face toward the rotary latches 14*a*; 14*b*, and essentially configured in the manner of a saw tooth. Furthermore, the pawls 27*a*; 27*b* are disposed to be spring-loaded, in such a manner that their pawl activation sections 28, which lie opposite one another, are pressed in the direction of the rotary latches 14*a*; 14*b* or against them. For this purpose, a pawl spring 33, for example, is provided, in each instance, which spring supports itself both on the lock box 2 and on the pawl 27*a*; 27*b*, in each instance.

On the activation section side end of the pawls 27*a*; 27*b*, an activation or contact projection 34 is provided, in each instance, which projection also extends in the direction of the rotary latches 14*a*; 14*b*. This activation projection 34 serves as a contact and engagement surface for an activation lever 35, with which the pawls 27*a*; 27*b* can be driven in a pawl activation direction K, about the pawl axis of rotation 31. In order for the activation lever 35 to be able to engage into the lock box 2 for this purpose, an engagement recess 36 is provided in the lid 4, which recess is dimensioned in such a manner that an activation section 39 of the activation lever 35 can pass through and the activation lever 35 can perform its pivoting movement without hindrance.

The activation lever 35 represents an outside triggering lever that can be activated from the vehicle exterior by pressing it, in the installed state of the door lock. In the non-installed state, the vehicle exterior represents a first (longitudinal) side 81 of the lock 1, particularly the side on which the longitudinal edge 5 of the lock box 2 is disposed. For this purpose, a known pushbutton mechanism 42*b* comprising a pushbutton lever is present, by means of which the activation lever 35 can be driven in the activation lever activation direction B. In particular, the pushbutton mechanism engages on the front wall 42*a* of the activation lever 35 at a suitable location, in a pushbutton activation direction D.

The activation section 39 is configured to be widened with reference to the activation lever side walls 37*a*, 37*b*, or to project away from them laterally on both sides. In this way, the activation lever 35 is configured in T shape at the activation side end. The activation section 39 serves to activate the pawls 27*a*; 27*b*. For this purpose, the activation section 39 stands in an active engagement with the two activation projections 34 of the pawls 27*a*; 27*b*. The pawls 27*a*; 27*b* can thereby be directly driven in the pawl activation direction K, by means of the activation lever 35, or stand in a direct connection with it, so that they can be driven in the pawl activation direction K. In particular, the activation section 39 lies against the two activation projections 34, for this purpose (FIG. 1), as will be discussed in greater detail below.

For this purpose, the activation lever 35 is mounted so as to rotate about an activation lever axis of rotation 41, which is perpendicular to the pawl axes of rotation 31 and parallel to the longitudinal walls 5, 6, in other words perpendicular to the transverse center plane 12. The activation lever axis of rotation 41 is furthermore perpendicular to the activation lever side surfaces 37. Therefore the activation lever 35 has a bearing recess 49 that is continuous from the one activation lever side wall 37 to the other, which recess is provided between the activation side end and the contact side end of the activation lever 35. It is furthermore practical if at least one, preferably two activation lever springs 45 is/are provided, which have the aim of turning the activation lever 35 counter to an activation lever activation direction B. Furthermore, the front wall 42*a* is configured to be slightly widened in the region of the bearing recess 49, so that two contact wings 50 that project laterally on both sides of the activation lever side walls 37, perpendicular, for practical purposes, are formed. The contact wings 50 serve as counter-bearings for the rotary movement of the activation lever 35 counter to the activation lever activation direction B or for the purpose of limiting the rotary movement of the activation lever 35 counter to the activation lever activation direction B, as will be discussed in greater detail below.

The activation lever 35 represents an outside triggering lever that can be activated from the vehicle exterior by pressing it, in the installed state of the door lock. In the non-installed state, the vehicle exterior represents a first (longitudinal) side 81 of the lock 1, particularly the side on which the longitudinal edge 5 of the lock box 2 is disposed. For this purpose, a known pushbutton mechanism, not shown, is present, by means of which the activation lever 35 can be driven in the activation lever activation direction B. In particular, the pushbutton mechanism engages on the front wall 42*a* of the activation lever 35 at a suitable location, in a pushbutton activation direction D.

Furthermore, the door lock 1 according to the invention has an inside release lever 51, which can be activated from the vehicle interior by pressing it, in the installed state of the door lock. In the non-installed state, the vehicle interior represents a second (longitudinal) side 82 of the lock 1, which lies opposite the first side, on which the longitudinal edge 6 of the lock box 2 is disposed. It is also practical if the inside release lever 51 is configured to be elongated and has two inside triggering level side surfaces 52 that are parallel to one another and a circumferential inside release lever circumference wall 53 that is perpendicular to the side surfaces 52. The inside release lever 51 furthermore has a front side 54 and a back side 55 that lies opposite the former. The inside release lever 51 has an inside release lever activation section 56 at one end, and a handle part 57 at the other end. The handle part 57 serves for gripping the inside release lever 51 by hand and pivoting it in an inside release lever activation direction I, as will be discussed in greater detail below. For this purpose, the inside release lever 51 has an inside release lever bearing bore 58 in the region of the activation side end, in other words in the inside release lever activation section 56, so that the inside release lever is mounted so as to rotate in the inside release lever activation section 56. In this connection, an inside release lever axis of rotation 59 is mounted parallel to the activation lever axis of rotation 41, but not coaxial to it. In particular, the inside release lever 51 is mounted above the activation lever 35 with reference to the bottom wall 3. It is furthermore practical if one, particularly two inside release lever rotary springs 60 is/are provided, which have the aim of turning the inside release lever 51 counter to an inside release lever activation direction I.

The inside release lever 51 therefore stands in connection with the inside release lever springs 60, so that it can be driven about the inside release lever axis of rotation 59, counter to the inside release lever activation direction I.

On the front side 54 of the inside release lever 51, in the region of the inside release lever activation section 56, a fork 61 having two fork arms 62 that are parallel to one another is provided. The fork arms 62 are configured to project away from the inside release lever circumference wall 53, and are disposed spaced apart from one another in such a manner that the activation lever 35 can be accommodated, particularly laterally guided, between them. In particular, the fork arms 62 are configured to essentially project away radially with reference to the inside release lever axis of rotation 59. The fork arms 62 furthermore have an activation edge 63, in each instance, that faces the back side 55 of the inside release lever 51. It is practical if a lever accommodation depression 64 for accommodating the activation lever 35 is furthermore provided between the two fork arms 62. The fork arms 62 serve for activation of the activation lever 35 by means of the inside release lever 51, as will be discussed in greater detail below.

Furthermore, the inside release lever 51 has a contact projection 65 in the region of the inside release lever activation section 56, which projection is disposed adjacent to the activation edge 63 in the circumference direction, and also is disposed to project away, essentially radially, with reference to the inside release lever axis of rotation 59. It is furthermore practical if the contact projection 65 is disposed centered with reference to the width of the inside release lever 51. In this connection, the width of the inside release lever 51 corresponds to the distance of the two side surfaces 52 from one another.

As has already been explained, the two levers 35; 51 are connected with the lock box 2 so as to rotate about their axes of rotation 41; 59, in each instance. For this purpose, the levers 35; 51 are directly connected with the lid 4, for example, in that bearing lips (not shown) that project away from the lid 4 are formed onto the lid 4 in known manner, which lips have bearing bores and bearing pins guided in them, on which the levers 35; 51 are mounted, for mounting the levers 35; 51.

Figure 3:
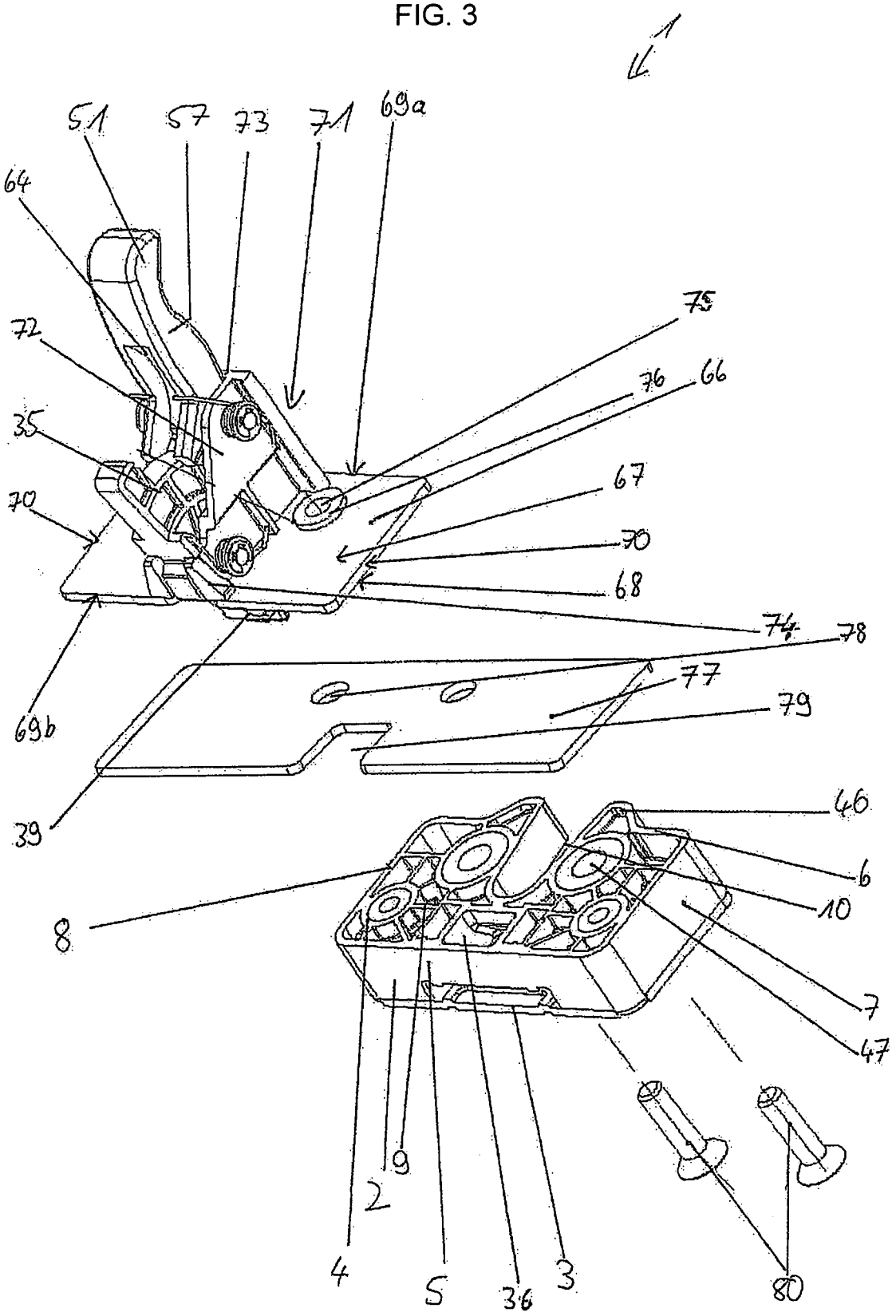

According to another aspect of the invention, while the levers 35; 51 are not mounted on the lock box 2 directly, they are instead mounted on a sheet 66 specifically provided for this purpose (FIG. 3).

The sheet 66 is preferably configured to be plate-shaped and preferably block-shaped, and has a sheet top side 67, which is flat, for practical purposes, a sheet underside 68 that is perpendicular to the former, and also flat, for practical purposes, as well as two longitudinal sheet edges 69*a*; b and two transverse sheet edges 70 that are perpendicular to the longitudinal sheet edges 69 and to the sheet top side 67. Furthermore, the sheet 66 has means for mounting the two levers 35; 51, so as to rotate, particularly a bearing body or bearing block 71. The bearing block 71 has two bearing tabs or plates 72 that are parallel to one another, and extend perpendicular to the sheet top side 67 and away from it and parallel to the transverse sheet edges 70. Furthermore, the bearing block 71 has an end plate 73 that also extends perpendicular to the sheet top side 67 and away from it. The end plate 73 follows the bearing tabs 72, transverse to them, and ends the bearing block 71 toward the one longitudinal sheet edge 69*a*. Toward the opposite longitudinal sheet edge 69*b*, the bearing block 71 is open, whereby there, two stops 74 are disposed, which also extend away from the sheet top side 67. The stops 74 serve as counter-bearings for the rotary movement of the activation lever 35 counter to the activation lever activation direction B. They therefore limit the rotary movement of the activation lever 35 counter to the activation lever activation direction B. Furthermore, the bearing block 71 is connected with the sheet 66, in firm and preferably releasable manner. In particular, the bearing block 71 is screwed onto the sheet 66, whereby preferably, two countersunk screws 83 (FIG. 9) are used. For this purpose, the bearing block 71 has an attachment plate 84, for example, which extends perpendicular to the two plates 72; 73 and ends at these on the underside, on the side of the bearing block 71 that therefore faces the sheet 66. Furthermore, two attachment threads 85 are provided in the attachment plate 84, and two additional attachment recesses 86 are provided in the sheet 66, on which the heads of the countersunk screws 83 support themselves.

The bearing block 71 preferably consists of plastic and is preferably produced by means of casting or extrusion. It is practical, in this connection, if the plates 72; 73; 84 and the stops 74 are firmly connected with one another, particularly structured as one part or in one piece.

Each bearing plate 72 furthermore has a continuous activation lever mounting recess, in each instance, for mounting the activation lever 35, and a continuous inside release lever mounting recess for mounting the inside release lever 51. In this connection, the inside release lever mounting recesses are preferably disposed adjacent to the end plate 73, and the activation lever mounting recesses are preferably disposed adjacent to the stops 74. The inside release lever mounting recesses are disposed at a slant above the activation lever mounting recesses, with reference to the sheet top side 67. A bearing pin or a bushing for mounting the levers 35; 51 is introduced into the mounting recesses, in each instance, and the levers 35; 51 are mounted on these. In this connection, the levers 35; 51 are disposed between the two bearing plates 72. In particular, the levers 35; 51 are guided laterally between the bearing plates 72. For this purpose, the bearing plates 72 are spaced apart from one another in the region of the inside release lever mounting recesses and there where the inside release lever 51 is situated, or when pivoted in spaced apart from one another by the amount of the width of the inside release lever 51, and spaced apart from one another by the amount of the width of the activation lever 35 in the region of the activation lever mounting recesses. The distance between the bearing plates 72 therefore decreases toward the activation lever 35, for which purpose the bearing plates 72 preferably run toward one another, preferably at a bend. The width of the activation lever 35 corresponds to the distance of the two side walls 37 from one another.

Furthermore, the levers 35; 51 are disposed in such a manner that the front wall 42*a* of the activation lever 35 faces the front side 54 of the inside release lever 51. Furthermore, the two activation edges 63 of the fork arms 62 lie against the two driver studs 44. As a result, the activation lever 35 stands in a direct active connection with the inside release lever 51, so that it can be driven in the activation lever activation direction B, by way of the fork arms 62 and the driver studs 44. The activation lever 35 can thus be driven in the activation lever activation direction B by means of the inside release lever 51.

So that the activation lever 35 can engage through the sheet 66 from the top side 67 to the underside 68, with its activation section 39, the sheet 66 furthermore has an access recess (not shown), particularly a groove-shaped recess. The access recess is introduced into the longitudinal sheet edge 69*b*, for example, on which the stops 74 are also provided.

Furthermore, the attachment sheet 66 has two attachment recesses 75 that go through from the sheet top side 67 to the sheet underside 68, and it is practical if these are disposed adjacent to the bearing plates 72, in each instance. The attachment recesses 75 serve for accommodating attachment bushings 48, which are introduced into the attachment recesses 75. The attachment bushings 48 have an inside thread and a bushing edge 76 with which they support themselves on the sheet top side 67.

Furthermore, the sheet 66 preferably consists of metal, preferably steel.

Attachment of a door lock generally takes place by means of attaching the lock onto a holding sheet 77 provided in the door for this purpose (FIG. 3). In the present case, the holding sheet 77 also has attachment recesses 78 for accommodating the attachment bushings 48 and an access recess 79 for the activation lever 35.

Now, the entire lever mechanism, consisting of activation lever 35 and inside release lever 51, can be attached to the lock box 2 and the holding sheet 77 as a compact unit, on the lid side, by means of the attachment sheet 66. For this purpose, the attachment recesses 75; 78; 47 are disposed to align with one another, in pairs, and the attachment bushings 48 are introduced into the attachment recesses 75; 78; 47. In this connection, the holding sheet 77 is positioned between the lid 4 and the attachment sheet 66. Subsequently, screws 80 are screwed into the attachment bushings 48 from the bottom wall 3, and the attachment sheet 66, the holding sheet 77, and the lock box 2 are firmly but releasably connected with one another.

In the following, the method of functioning and the activation of the door lock 1 according to the invention will be explained in greater detail:

In an open position of the door lock 1 (not shown), the locking pin 11 is situated outside of the lock box 2, between the channels 18 of the two rotary latches 14*a*; 14*b*. The locking projections 17 pass through the slit 19 and are pressed against the slit edges 19*a*, which serve as a stop and are perpendicular to the bottom wall 3, by means of the force of the rotary latch springs 26, with their locking projection back walls 20. Furthermore, the pawls 27*a*; 27*b* lie against the circumference wall 21, adjacent to the first engagement projections 22, under the pressure of the pawl rotary springs 33, with their pawl engagement projections 32.

The activation lever 35 passes through the two access recesses 79 and the engagement recess 36, and engages into the lock box 2, with its activation section 39, and lies on the stops 74 in the open position of the door lock 1 according to the invention, under spring stress, with its contact wings 50, and on the rounded-off activation projections 34 of the pawls 27*a*; 27*b* with its activation section 39. The inside release lever 51 also lies on the driver studs 44, under spring stress, with the fork arm activation edges 63, but without activating the activation lever 35. The inside release lever 51 furthermore lies against the end sheet 73, on the inside, with its back side inside release lever circumference wall 53, because of the force of the inside release lever springs 60.

If the door is closed, the locking pin 11 presses against the channels 18 of the rotary latches 14*a*; 14*b*, and the rotary latches 14*a*; 14*b* are pivoted in opposite directions, about the rotary latch axes of rotation 16, counter to the pressure of the rotary latch springs 26 and partly the pawl rotary springs 33, in the locking rotation direction S, so that the locking projections 17 are moved toward one another and partly surround the locking pin 11, whereby the locking projections 17 are then situated partly within the locking pin recess 10 of the lock box 2, with the locking pin 11. Because of the rotary movement, the pawl engagement projections 32 furthermore get into the first engagement recesses 24, and engage there due to the spring pressure of the pawl rotary springs 33 (safety engagement). In this position, the two rotary latches 14*a*; 14*b* are blocked and can no longer be rotated opposite the locking rotation direction 5, by means of the force of the rotary latch rotary springs 26. In this connection, the locking projections 17 are disposed rotated so far toward one another that the locking pin 11 can no longer escape from the region between the channels 18. In this connection, the activation lever 35 remains in its previous position, under spring stress. Since the pawls 27*a*; 27*b* are spaced slightly farther apart from the rotary latches 14*a*; 14*b* than in the open position of the door lock 1, however, the activation lever 35 does not necessarily continue to lie on the activation projections 34 with its activation section 39.

If the rotary latches 14*a*; 14*b* are rotated further toward the channels 18 by means of the pressure of the locking pin 11, in the locking rotation direction S, the pawl engagement projections 32 get into the second engagement recesses 25 of the rotary latches 14*a*; 14*b*, in each instance, and engage there due to the spring force of the pawl rotary springs 33. The rotary latches 14*a*; 14*b* are then situated in the complete locking position (FIG. 1), in which the two rotary latches 14*a*; 14*b* are again blocked and can no longer be rotated counter to the locking rotation direction S, by means of the force of the rotary latch rotary springs 26. In this way, the lock 1 is held in the locked position. In the locked position, it is practical if the activation lever 35 once again lies on the activation projections 34 with its activation section 39.

In order to open the door lock 1 according to the invention, from the pre-engaged safety engagement or from the locked position (FIG. 1), the activation lever 35 is activated in that it is pivoted, for example counter to the force of the activation lever springs 45, in the activation lever activation direction B, about the activation lever axis of rotation 41, so that the activation section 39 of is moved away from the rotary latches 14*a*; 14*b*. This takes place either directly from the exterior of the vehicle, by means of activation of the pushbutton mechanism, or indirectly, from the interior of the vehicle, by means of pressing on the handle part 57 of the inside release lever 51, so that the latter is pivoted in the inside release lever activation direction I. In this connection, the activation edges 63 of the fork arms 62 engage on the driver stud 44, slide along it, and take it with them, so that the activation lever 35 is pivoted in the activation lever activation direction B. The activation lever 35 and the inside release lever 51 are thereby pivoted toward one another, whereby the activation lever 35 is accommodated between the fork arms 62, in certain regions, and guided between them.

Pivoting of the activation lever 35 brings about the result that the activation projections 34 are carried along by the activation section 39 that lies against them, and thereby the pawls 27*a*; 27*b* are rotated in the pawl rotation direction K, counter to the pressure of the pawl rotary springs 33, and, because of the undercut structure of the rotary latch engagement projections 22, 23, counter to the pressure of the rotary latch spring 26, so far until the pawl engagement projections 32 have been pressed completely out of the first or second engagement recesses 24, 25. The rotary latches 14*a*; 14*b* then snap back into their open starting position, under the pressure of the rotary latch springs 26, until the projection back walls 20 bump up against the slit edges 19*a* of the slit 19. The locking pin 11 is pressed out of the lock box 2 by means of the channels 18. After the activation lever 35 or the inside release lever 51 are let go, they snap back into their starting position by means of the pressure of the springs 45; 60, in each instance.

The pivoting movement of the inside release lever 51 in the inside release lever activation direction I is limited, in this connection, in that the stop projection 65 of the inside release lever 51 bumps up against the end sheet 73 on the inside. The pivoting movement of the activation lever 35 in the activation lever activation direction B is also limited in this position, since the activation lever 35 pivots into the lever accommodation depression 64 if it is pivoted too far, farther in the activation lever activation direction B than is necessary for activation, and makes contact with the lever accommodation depression 64 with its stop projection back edge 43.

The inside release lever 51 and the activation lever 35 therefore stand in an active connection with one another, coupled in such a manner that the rotary movement of the inside release lever 51 in the inside release lever activation direction I can be transferred to the activation lever 35, particularly without any delay, in such a manner that the activation lever 35 is pivoted in the activation lever activation direction B. In this connection, the inside release lever activation direction I and the activation lever activation direction B go in opposite directions. In particular, the activation lever 35 can be driven in the activation lever activation direction B by means of the rotary movement of the inside release lever 51 in the inside release lever activation direction I. Furthermore, the coupling is configured in such a manner that the rotary movement of the activation lever 35 in the activation lever activation direction B cannot be transferred to the inside release lever 51. In particular, the inside release lever 51 cannot be driven in the inside release lever activation direction I by means of the rotary movement of the activation lever 35 in the activation lever activation direction B. Only the activation lever 35 therefore stands in connection with the pushbutton mechanism so as to be driven. Therefore only slight forces are necessary to press down on the activation lever 35.

Coupling by way of the driver studs and the fork arms has the advantage, for one thing, that the direction for pressing is achieved, in other words the lock can be activated by pressing on it, from the outside and from the inside. Because the activation lever is pivoted into the inside release lever, in telescoping manner, the arrangement is very space-saving. Furthermore, the activation lever is additionally guided in the inside release lever with shape fit, since its width preferably corresponds to the distance of the fork arms from one another. Furthermore, the lever design is symmetrical to the center plane, so that installation is facilitated. Furthermore, the symmetrical arrangement has the advantage that jamming of the levers is prevented.

It is furthermore advantageous that the entire lever mechanism that is required for activation or unlocking of the lock according to the invention can be attached to the lock box as a complete unit, by means of the external mounting, on an attachment sheet specifically provided for this purpose. In this connection, this type of mounting is, of course, not restricted to the lever mechanism that has been described and can be activated from close up, in two ways. This makes it possible to use uniform lock boxes with components uniformly disposed in them for locks that can be activated in different ways, and to attach the lever mechanism, in each instance, to the lock box, depending on the desired type of activation, without any additional adjustments having to be undertaken. Only the activation section of the activation lever has to be configured in such a manner that it can interact with the components disposed in the lock box. For example, a remote activation device can also be present, by means of which the activation lever can be activated from a remote location, for example from the vehicle interior. Furthermore, of course, only one rotary latch with a pawl can be present, or only one pawl can be present for both rotary latches. However, the design described has the advantage that only slight forces are required for activating the lock, and a symmetrical structure is possible, which significantly simplifies production and also installation, since there is no longer any risk that the two rotary latches will be confused with one another.

Another advantage is that the vehicle door lock according to the invention has only a small number of individual parts, and nevertheless only slight forces are required for activating the lock. This is because the coupling points or regions of the two levers, for example the distance of the driver studs from the axis of rotation of the activation lever, are selected in such a manner that the lever mechanism moves very easily.

The invention claimed is:

1. A vehicle door lock having a rotary latch arrangement for locking doors of motor vehicles, comprising:

a first side and a second side opposite to said first side;

two rotary latches that are mounted so as to rotate;

two engagement blocking elements, wherein each of the engagement blocking elements interacts with one of the two rotary latches, wherein said engagement blocking elements are configured to interact with the rotary latches, locking the lock;

an activation lever, being rotatably mounted about an activation lever axis of rotation, wherein the engagement blocking elements are configured to be directly activated by means of the activation lever wherein by means of rotation of the activation lever in an activation lever direction B a locking action is released, wherein the activation lever is configured to be activated from the first side of the lock by pressing on said activation lever, and a release lever being rotatably mounted about a release lever axis, the release lever axis being parallel but not coaxial to the activation lever axis of rotation, wherein said release lever is configured to be activated, by being rotated in a release lever activation direction I, directly, by means of pressing on said release lever from the second side of the lock;

wherein the activation lever is configured to be rotated and driven in the activation lever direction B by means of a rotary movement of the release lever in the release lever activation direction I, wherein the activation lever activation direction B and the release lever activation direction I are opposite to one another, and wherein the activation lever has an activation section for activating the blocking elements at one end, and is coupled with the release lever at another end; and wherein the release lever has a release lever activation section for activating the activation lever at the one end and a handle part, which serves for gripping the release lever by hand and pivoting it in the release lever activation direction I, at another end;

wherein the activation lever has two activation lever side walls that are parallel to one another, and a circumferential activation lever circumference wall having a front wall and a back wall;

wherein two driver studs are provided as means for coupling, wherein said studs project away laterally from said activation lever side walls.

2. The vehicle door lock according to claim 1, wherein the release lever and the activation lever are uncoupled from one another, so that the release lever cannot be driven in the release lever activation direction (I) by means of the rotary movement of the activation lever in the activation lever activation direction (B).

3. The vehicle door lock according to claim 1, wherein the activation lever, at the other end, has a projecting stop projection that is directed away from the activation section, which projection is configured as an extension of the front wall and has a stop projection back edge that faces away from the front wall.

4. The vehicle door lock according to claim 1, wherein an activation lever axis of rotation is perpendicular to a pawl axes of rotation, about which axes the blocking elements are rotatably mounted.

5. The vehicle door lock according to claim 1, further comprising:

a first spring coupled to said activation lever configured to bias said activation lever against a rotation in a direction B; and a second spring coupled to said release lever configured to bias said release lever against rotation in an activation direction I.

6. The vehicle door lock according to claim 1, wherein the release lever has two release lever side surfaces that are parallel to one another, and a circumferential release lever circumference wall that is perpendicular to the side surfaces.

7. The vehicle door lock according to claim 1, wherein the release lever has a front side and a back side that lies opposite said front side.

8. The vehicle door lock according to claim 1, wherein the release lever is mounted so as to rotate in the release lever activation section.

9. The vehicle door lock according to claim 1, wherein the release lever is mounted above the activation lever with reference to a bottom wall of a lock box of the lock.

10. The vehicle door lock according to claim 1, wherein the release lever has a fork having two fork arms that are parallel to one another, in a region of the release lever activation section.

11. The vehicle door lock according to claim 5, wherein the release lever has a fork having two fork arms that are parallel to one another, in the region of the release lever activation section, and wherein the activation lever is configured to be driven by means of the release lever, by way of the fork arms and said driver studs of the activation lever.

12. The vehicle door lock according to claim 10, wherein the release lever has two release lever side surfaces that are parallel to one another, and a circumferential release lever circumference wall that is perpendicular to the side surfaces and wherein the fork arms are configured to project away from the release lever circumference wall and are disposed spaced apart from one another, wherein that the activation lever is accommodated between them, in certain sections.

13. The vehicle door lock according to claim 11, wherein the release lever has a front side and a back side that lies opposite to said front side, and wherein the fork arms have an activation edge that faces the back side of the release lever, in each instance, wherein the activation edges stand in an active connection with the driver studs.

14. The vehicle door lock according to claim 13 wherein the release lever, in the region of the release lever activation section, has a stop projection that is disposed adjacent to the activation edge is disposed to project away essentially radially with reference to the release lever axis of rotation.

15. The vehicle door lock according claim 12 wherein a lever accommodation depression is present between the two fork arms, into which depression the activation lever can pivot when it is activated.

16. The vehicle door lock according to claim 1, wherein the activation lever and the release lever are configured to be pivoted toward one another when the release lever is activated.

17. The vehicle door lock according to claim 13 wherein the release lever lies against the driver studs with the fork arm activation edges in the non-activated position, but without activating the activation lever.

18. The vehicle door lock according to claim 14, wherein the pivoting movement of the release lever in the release lever activation direction I is limited by means of the stop projection of the release lever, which projection lies against a stop sheet, in the case of maximal pivoting.

19. The vehicle door lock according to claim 15, wherein the activation lever has two activation lever side walls that are parallel to one another, and a circumferential activation lever circumference wall having a front wall and a back wall and wherein the activation lever at the other end has a projecting stop projection that is directed away from the activation section, which projection is configured as an extension of the front wall and has a stop projection back edge that faces away from the front wall and wherein the pivoting movement activation lever in the activation lever activation direction B is limited in that the activation lever lies against the lever accommodation depression with a stop projection back edge in the case of maximal pivoting.

20. The vehicle door lock according to claim 1, wherein the vehicle door lock has a sheet on which a lever mechanism that has the release lever and the activation lever is mounted, and by means of which the lever mechanism is attached to the lock box of the lock as a unit.

21. The vehicle door lock according to claim 20, wherein the sheet has an access recess through which the lever mechanism engages into the lock box.

22. The vehicle door lock according to claim 1, wherein said activation lever of the vehicle door lock is configured to be activated by a mechanism.

23. The vehicle door lock according to claim 18, wherein the two driver studs project away from the activation lever side walls in a perpendicular manner.

24. The vehicle door lock as in claim 14, wherein the stop projection is disposed to project away essentially radially with reference to the release lever axis of rotation.

25. The vehicle door lock as in claim 12, wherein the activation lever is at least partially laterally guided between the fork arms.

26. The vehicle door lock as in claim 21, wherein the access recess is a groove shaped recess.

27. The vehicle door lock as in claim 1, wherein the lock is installed in a door of a vehicle and wherein the first side of the lock is an exterior side of the door, and the second side of the lock is an interior side of the door.

* * * * *